United States Patent [19]

Ericksson

[11] Patent Number: 4,880,672

[45] Date of Patent: Nov. 14, 1989

[54] METHOD AND APPARATUS FOR BLADECOATING OF A MOVING WEB

[75] Inventor: Tore Ericksson, Klässbol, Sweden

[73] Assignee: Inventing S.A., Lausanne, Switzerland

[21] Appl. No.: 232,540

[22] Filed: Aug. 15, 1988

Related U.S. Application Data

[63] Continuation of Ser. No. 873,529, Jun. 12, 1986, abandoned.

[30] Foreign Application Priority Data

Jun. 12, 1985 [SE] Sweden ..... 8502927

[51] Int. Cl.[4] ..... B05D 3/12; B05C 11/02

[52] U.S. Cl. ..... 427/356; 118/126; 118/413

[58] Field of Search ..... 118/126, 413; 427/356, 427/358

[56] References Cited

U.S. PATENT DOCUMENTS

| | | | |
|---|---|---|---|
| 3,187,718 | 6/1965 | Coghill | 118/126 |
| 3,882,817 | 5/1975 | Zink | 118/126 |
| 4,169,425 | 10/1979 | Wohrle | 118/126 X |
| 4,331,713 | 5/1982 | Girard et al. | 118/126 X |
| 4,405,661 | 9/1983 | Alheid | 118/413 X |

FOREIGN PATENT DOCUMENTS

| | | |
|---|---|---|
| 3001073 | 4/1981 | Fed. Rep. of Germany . |
| 79051645 | 6/1979 | Sweden . |
| 2035144 | 6/1980 | United Kingdom . |

*Primary Examiner*—Shrive Beck
*Assistant Examiner*—Alain Bashore
*Attorney, Agent, or Firm*—Burns, Doane, Swecker & Mathis

[57] ABSTRACT

The invention refers to a method and a device for varying the application amount of a coating agent at the blade coating of a moving material web (24,40,51), preferably a paper web, by corresponding control of the engagement pressure of the coating blade (20,43,50,68) against the web (24,40,51) which exhibits a coating agent surplus. The web is supported by a support, preferably a rotating support roller (25,41), and the blade is along one of its longitudinal sides clamped in a blade holder (21,44,49,69), moreover the blade is initially, with a certain force and thereby in an obtained arcuate shape, brought, with the opposite longitudinal side thereof, into engagement with the web, in a certain given angle between blade tip and web, and with a thereby defined engagement area.

A control pressure is exerted onto the major side of the blade when the engagement pressure is to be changed, the attack point of the control pressure on the blade is displaced in the transverse direction of the blade, towards or away from the web. At the same time the size of the control pressure is adjusted. Said displacement and adjustment are done partly to provide the desired blade engagement pressure and partly to mainly maintain the angle between the blade tip and the web.

13 Claims, 6 Drawing Sheets

| A | B | C | D | E | F | G | H | I | J | K | L | M |
|---|---|---|---|---|---|---|---|---|---|---|---|---|
| 0,254 | 30° | CIRCLE-ARC | 108,5 | -48 / -105,6 | 50 / -11,8 | 20 / 0 | 2,45 | BILLBL. 1-SIDE | 15 | 300 | 57 / 900 | 18 |
| -"- | -"- | -"- | -"- | -"- | -"- | 30 / -2,8 | 3,05 | -"- | -"- | -"- | -"- | 14,5 |
| -"- | -"- | -"- | -"- | -"- | -"- | 40 / -6,84 | 5,0 | -"- | -"- | -"- | -"- | 12,5 |
| -"- | -"- | -"- | -"- | -"- | -"- | 45 / -9,2 | 8,8 | -"- | -"- | -"- | -"- | 11,2 |
| 0,305 | -"- | -"- | -"- | -"- | -"- | 25 / -1,2 | 4,67 | -"- | 12 | 600 | -"- | 19 |
| -"- | -"- | -"- | -"- | -"- | -"- | 35 / -4,65 | 6,35 | -"- | -"- | -"- | -"- | 15,5 |
| -"- | -"- | -"- | -"- | -"- | -"- | 45 / -9,2 | 15,2 | -"- | -"- | -"- | -"- | 12,5 |
| 0,381 | -"- | -"- | -"- | -"- | -"- | 20 / 0 | 8,2 | BILLBL 2-SIDE | -"- | 300 | 54 / 550 | 30 |
| -"- | -"- | -"- | -"- | -"- | -"- | 30 / -2,8 | 10,3 | -"- | -"- | -"- | -"- | 25 |
| -"- | -"- | -"- | -"- | -"- | -"- | 40 / -4,7 | 16,7 | -"- | -"- | -"- | -"- | 18,5 |
| -"- | -"- | -"- | -"- | -"- | -"- | 45 / -9,2 | 29,5 | -"- | -"- | -"- | -"- | 15,5 |
| 0,305 | -"- | -"- | -"- | -"- | -"- | 30 / -2,8 | 5,3 | -"- | 15 | 500 | 53/ 450 | 28 |
| -"- | -"- | -"- | -"- | -"- | -"- | 40 / -4,7 | 8,6 | -"- | -"- | -"- | -"- | 25 |
| -"- | -"- | -"- | -"- | -"- | -"- | 45 / -9,2 | 15,3 | -"- | -"- | -"- | -"- | 20 |
| 0,457 | 40° | -"- | 157 | -48 / -295 | 70 / -23,2 | 30 / -1,4 | 9,3 | INV. BL. 1-SIDE | 35 | 900 | 58/ 950 | 14,5 |
| -"- | -"- | -"- | -"- | -"- | -"- | 40 / -5,3 | 11,0 | -"- | -"- | -"- | -"- | 13,0 |
| -"- | -"- | -"- | -"- | -"- | -"- | 50 / -10,4 | 13,5 | -"- | -"- | -"- | -"- | 11,0 |
| -"- | -"- | -"- | -"- | -"- | -"- | 60 / -16,5 | 23,2 | -"- | -"- | -"- | -"- | 9,5 |
| | | | | | | | | | | | | |

FIG.7

METHOD AND APPARATUS FOR BLADECOATING OF A MOVING WEB

This application is a continuation of application Ser. No. 873,529, filed June 12, 1986, now abandoned.

BACKGROUND AND SUMMARY OF THE INVENTION

The present invention refers to a method of varying the application amount of coating agent at bladecoating of a moving material web, preferably a paper web, by corresponding control of the engagement pressure of the coating blade against the web, which is supported by a support, preferably a rotating support roller, and which exhibits a coating agent surplus, said blade being along one of the longitudinal edges thereof clamped into a blade holder, the opposite longitudinal edge of said blade being initially brought into engagement with the web by means of a control pressure acting against the main surface of the blade, whereby the blade has a curved shape and forms with the tip portion thereof a certain predetermined angle with the web, so that a certain area of engagement is defined or formed. The invention also refers to an apparatus for carrying the method into effect.

In bladecoating devices the application amount of the coating agent is regulated by the engagement pressure of the blade against the paper web, and the pressure per surface unit for the engagement area between the blade and the web, i.e. the work area or engagement area, substantially determines the application amount of the coating agent. The blade pressure is often regulated thereby that the distance between the bladeholder and the support is changed. Normally the engagement surface or work surface of the blade normally extends namely in parallel with the web surface and the roller surface respectively. However, when the bladepressure is varied in the way described above, this parallelity is lost, because a change in the blade deflection occurs and thereby a change of the engagement area between the blade and the web also occurs. Thus, when it is decided to change the application amount by means of this known technique, the bladepressure against the roller will increase if the distance between the roller and the bladeholder is decreased, but at the same time the angle between web and blade top will decrease. This means initially that the surface of the blade will form an oblique angle relative to the paper web whereby only a portion of the surface will be in engagement with the web. The engagement pressure per unit of surface area, which determines the application amount will then increase substantially, causing a decreased application amount. By and by as the blade is worn in, the engagement portion of the work surface with the web will increase until the entire work surface area is in engagement with the web. During this period the application amount will increase. When the blade again has been worn in, the entire engagement surface will engage the web.

As appears from the above example, this type of regulation has two drawbacks:

1. For each change of the distance between the blade holder and the roller, the blade will have a time period of wearing in during which the application amount is not constant.

2. The changes in the application amount will have different action depending on various factors such as the springing properties of the blade material, the protruding length of the blade, the thickness of the blade and the initial top angle of the blade.

Further to this there are various methods of changing the bladepressure. The majority of these methods is burdened with the drawbacks described above.

Moreover, it has previously been suggested to solve the present problem by turning the bladeholder around the intersection point between an imaginary line which forms an elongation of the straight part of the clamped blade, and an elongation of that part of the blade which is in engagement with the paper web. This known solution is mechanically complicated and thereby utterly sensitive as to function, although, with certain preconditions, it gives the opportunity to change the bladepressure without change of the bladeangle. However, with this known technique it is only possible to achieve a uniform pressure regulation along the entire length of the blade. On the other hand this technique excludes the possibility of so called profile regulation—i.e. a change of the application amount across the web. The demand for such a profile regulation is rapidly increasing, i.e. dependent on increased web velocities and increased application amount and higher demands for quality.

The object with the present invention is to provide a method and a device which in a satisfying way makes possible a simple and functional regulation, for example continuous fine adjustment of the application amount during the application without changing of the engagement area of the blade against the web, and also a simultaneous possibility to desired variations of the application amount across the web—i.e. possibilities to a so called profile regulation.

According to the invention this is achieved with the method described in the preamble herein substantially thereby that the engagement pressure of the blade against the web, with a substantially maintained initial engagement area against the web, is controlled by external force application along the concave bladeside of the blade between the clamping position and the engagement area.

According to a suitable embodiment of the invention, said force application on the blade occurs along a path which substantially coincides with the arcuate shape of the blade. Said blade is then suitably substantially shaped as an elliptical or circular arc.

According to one embodiment of the invention said force application suitably occurs simultaneously along the entire length of the blade, and this is achieved by means of a pressure means of a support means which is displacable along the concave side of the blade. The pressure means or support means can then be displaced manually or be for example computer controlled depending on the application amount which is sensed each time.

According to another embodiment of the invention varying force application is performed along the length of the blade, and this is suitably achieved by means of a number of partial pressure means or partial support means arranged in a line along the entire length of the blade, said partial pressure means or partial support means being independently controllable.

Suitably said varying force application on the blade can be provided via a rod which is flexible at least in one plane and which is located between the pressure means and the blade side facing said means, said rod being arranged along the entire length of the blade and arranged in engagement with the blade.

The invention also comprises a device for carrying into effect the preamblewise described method, said device being substantially characterized by pressure means or support means arranged to cooperate with a predeterminable pressure with the blade along the concave side thereof.

According to a suitable embodiment, the pressure means or support means comprises a support roller which is arranged turnable, and a support which is arranged to be adjustable along a path substantially coinciding with the arcshape of the blade, said support roller extending along the entire length of the blade.

Suitably the support roller is fastened on a rotatable shaft which is arranged at the blade holder, said support being arranged adjustable along a substantially circular path.

According to a further embodiment of the invention the device comprises a number of parallel pressure means or partial support means arranged in line after each other along the length of the blade and each arranged to be brought to point engagement with the blade.

Suitably a rod which is flexible at least in a plane and which extends along the entire length of the blade, is arranged in mechanical contact between the concave side of the blade and the pressure means.

BRIEF DESCRIPTION OF THE DRAWINGS

In the following the invention will be closer described with reference to some embodiments which are shown on the appended drawings.

FIG. 7 is a table showing the result of some tests which have been performed with a device according to the invention.

DETAILED DESCRIPTION OF THE PREFERRED EMBODIMENTS

Figure 1:
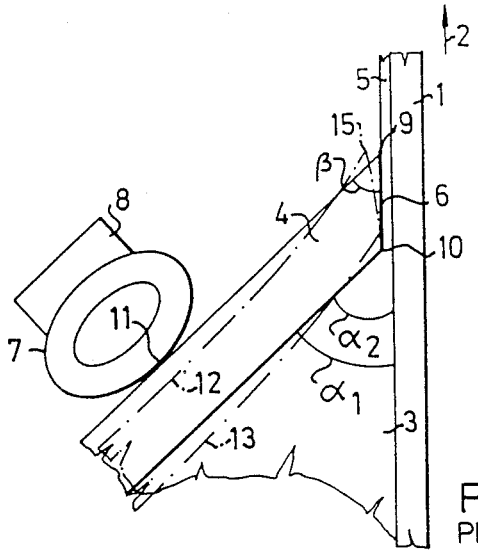
FIG.1 PRIOR ART
FIG. 1 is a sketch of principal of a previously known bladepressure regulation device.

In FIG. 1 the principal structure of a known device for regulation of the blade pressure in a blade coater with a coating blade which with a bevel surface engages the paper web intended to agent is performed by changing the engagement pressure of the flexible blade against the paper web. The paper web which in the device according to FIG. 1 is designated by 1, is here driven by means of a rotating rubber roller which however is not shown in the drawing. Hereby the paper web 1 is moved in the direction of arrow 2, and the surplus of coating mass 3 is added in a suitable way to a nip formed between the coating blade 4 and the paper web 1.

A pneumatic/mechanical adjustment device is designated by 7. In the shown embodiment it consists of a rubber hose which is shown in crossection and which in turn is arranged at a fixed support 8 of suitable type and which is arranged to press against the blade 4 in the point 11. If a suitable air pressure is maintained in the hose 7, a corresponding force is achieved which presses the blade 4 against the paper web 1.

By this pressing of the blade 4 against the paper web, a controllable amount of application agent passes through said nip and forms a coating agent layer 5 on the paper web. The coating blade 4 which in this example consists of a flexible steel blade, has a work surface 6 in the form of a bevel which is parallel to the paper web at the place of the engagement. The angle $\alpha_1$ indicates the acute engagement angle of the blade against the paper web.

The bevel surface of blade 4 is previously ground in, and the blade top has the so called blade top angle $\beta$, i.e. the angle between the ground in bevel surface and the plane surface of the blade. The blade top angle $\beta$ should be chosen in a way that, for a certain adjustment of the coating device, the bevel surface 6 flatly engages the paper surface, i.e. so that the blade top angle $\beta$ equals the engagement angle. If the blade top angle $\beta$ of the preground blade does not coincide with the desired adjustment, the bevel surface 6 of the blade will not be in parallel with paper web 1. The consequence of this is that the blade 4 engages the paper web 1 either with the blade tip 9 or with the blade heel 10, resulting in that the desired application amount cannot be achieved and that the application amount becomes less due to the increased surface of pressure, which in turn depends on the reduced work surface area of the blade. The wear occurring on the bevel surface of the blade then leads to the eventual grinding of a new bevel surface which is parallel to the paper web at the same time as the application amount successibly increases until a new equilibrium is achieved. It is appreciated that it is difficult to predict the application amount which finally will be achieved in the new condition as defined by the grinding in. Furthermore, the variations in application amount during the wearing in will in many cases mean that a part of the production must be dumped.

By blade coating it is for several reasons often desired to change the application amount of the coating agent. For example the situation may occur that the production is to be switched from a paper quality with a smaller application amount to another paper quality with a bigger application amount. Also it often happens that variations occur in the application amount during the manufacture of one and the same paper quality. Such variations are not desirable and the aim is to reduce such variations by making necessary compensations by changed blade engagement force. Such variations may depend on several factors, partly on changes in the dry substance ratio or viscosity of the coating mass, the moisture ratio or surface roughness of the paper web etc.

The known device which is shown in FIG. 1, is like all similar devices for mechanical pressing of the blade, burdened with substantial drawbacks. In the shown device the application amount is changed by changing the force from the inflatable setting device 7. If for example it is desired to reduce the application amount, it is natural to increase force on the blade. For an increased air pressure in the hose 7 the bending down of the blade 4 is increased making the blade to take the dashed position 13 at the same time as the engagement point 11 takes the position 12. The bending down of blade 4 means i.e. that the blade tip 9 is moved to position 15 and that the engagement angle $\alpha_1$ is reduced to $\alpha_2$. From FIG. 2 it appears that the blade now rides on the heel 10 and the effective contact area between the blade and the paper web has been reduced, this also providing a reduction of the application amount. When the bevel surface of the blade eventually again has been worn in, the application amount increases again. This means that during the time period of a grinding in, i.e. from the moment when the blade pressure change was made, a faulty application amount is provided. Similar defects are inherent in all known coating plants which are equipped with pressing devices for changing the application amount of the coating agent.

Figure 2:
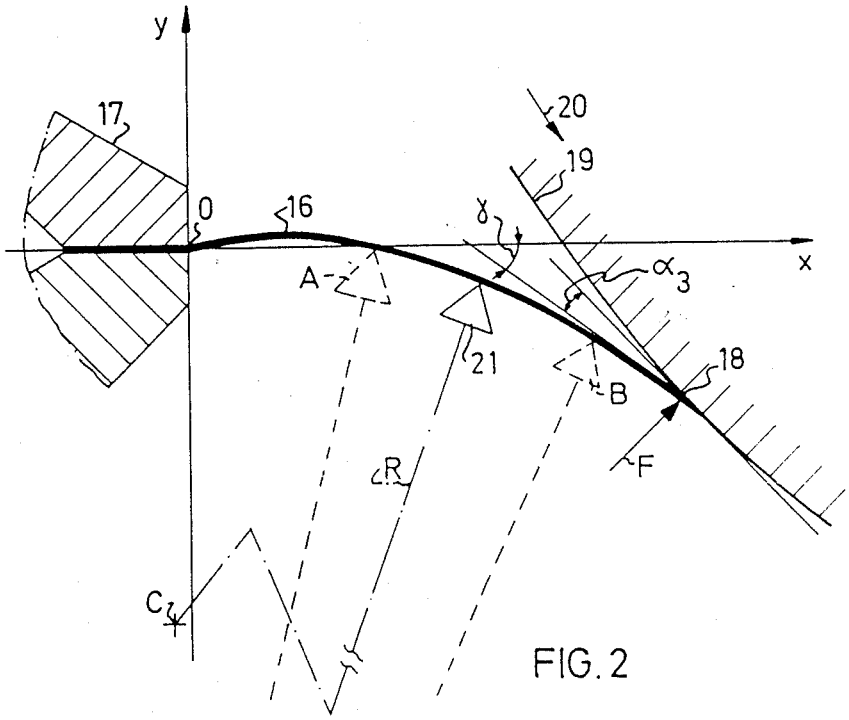
FIG. 2 is a sketch of principal of a device suggested according to the invention.

The present invention solves the above problem in a novel way. In FIG. 2 the principal structure of a device suggested according to the invention, wherein a coating blade 16 is fixedly clamped in a blade holder 17 of a conventional type. The bevel surface 18 of the blade 16 presses against the paper web 19 which in turn cooperates with a rotating roller which is not shown in the figure. The paper web 19 moves in the direction of arrow 20 in the shown example. The blade 16 forms an arc due to the forces acting thereon. The shown device comprises a mechanical support which has been denoted with a triangle 21 the apex of which pressing against the blade. In the position shown in FIG. 2 of the support 21, the blade is affected by a force from the support of a certain magnitude which i.a. depends on the extent on which the support presses the blade upwardly to the arc showing in the figure. The deflection angle of the blade has been denoted with $\gamma$ in FIG. 2, and this is the angle between the extension line of the plane surface of the blade at the point of engagement between the blade and the paper web, and the extension line of the straight portion of the blade, which is fixedly clamped in the blade holder.

It has now surprisingly been found that it is possible to carry out changes in the blade pressure in coating by means of the device shown in FIG. 2 without change of the blade engagement angle which in FIG. 2 has been denoted with $\alpha_3$. This is achieved thereby that by means of suitable mechanical devices the movable support 21 is brought to engage and press against the blade and the glide on the blade along an arc which largely follows the arc taken by the blade in its clamped position. The device functions thereby that the application amount becomes smaller when the support is brought to take position B while the application amount is bigger in the support position A. Thus, in principal one can say that the changes in application amount is achieved by a pressure point displacement along the concave blade side of the blade.

Practical tests with the device suggested according to the invention shown that this new technique brings about substantial advantages in regulating the application amounts. Thus, it has turned out that a suitable choice of the curve which the support 21 describes substantially along the bending profile of the blade also at relatively large changes of the force of engagement against the blade, with accompanying changes in application amount, does not bring about any or at least a completely negligible change of the engagement angle $\alpha_3$. This results in the surprising effect that a change of the position of support 21, i.e. is a displacement of the pressure point of the support 21 along the blade, immediately causes the desired effect, i.e. is brings about an immediate change of the application amount to the new desired application amount without any lapse of a certain time in order that the bevel surface of the blade again shall be ground in, which as mentioned is the largest disadvantage burdening the previously known plants exemplified in FIG. 1.

Moreover, it has turned out that the set values are reproducable, i.e. that a certain position for the support 21 along the given displacement curve of otherwise constant conditions, corresponds to a certain defined application amount.

In this way several substantial advantages have been gained by the invention. First, by changing the position of support 21 it is possible to immediately obtain the change of application amount strived for, and thereby the production losses due to defect quality of the coated paper has been eliminated in a simple way. Another substantial advantage is that the desired new application amount can be obtained by moving the support 21, i.e. by displacing the pressure point—into a position the influence of which on the application amount is previously known.

The circumstance that in this way a reproducibility has been achieved by the invention is of course of great value in order to compensate possible variations in the application amount due to external factors. Thus, it has turned out to be possible to control a device suggested according to the invention, via a control circuit comprising a device for measuring the coating agent amount applied in the coating plant, a microprocessor, and an adjustment means. In such a device a set desired application amount can be held almost constant. If for example due to external circumstances, the application amount tends to increase, a signal is provided by the measuring device, which then effects the adjustment device via the microprocessor, causing a compensation of the change of the application amount due to a corresponding displacement of the support 21.

As previously mentioned, the arc along which the support 21 exercises its pressure action on the blade should largely follow the arc which the blade takes in its clamped position. It has now surprisingly been found that if the arc which the support 21 describes is constituted by an elipse arc or circle arc, no or an almost completely negligible change of the blade engagement angle is obtained in displacement of the support between the end positions. It has also turned out that many structural advantages are obtained, especially if the arc consists of a circle arc. In FIG. 2 an x-y-coordinate system has been introduced in order to later make it possible to exemplify different positions on the centre of the circle arc as well as different values of corresponding diameters, and an origin has been located at the forward portion of the blade holder 17 and has been denoted by O. The X-axis extends in parallel with the fixedly clamped portion of the blade, and the y-axis extends perpendicular to the X-axis. The radius of the circle arc has been denoted by R, and the centre thereof by C.

Figure 3:
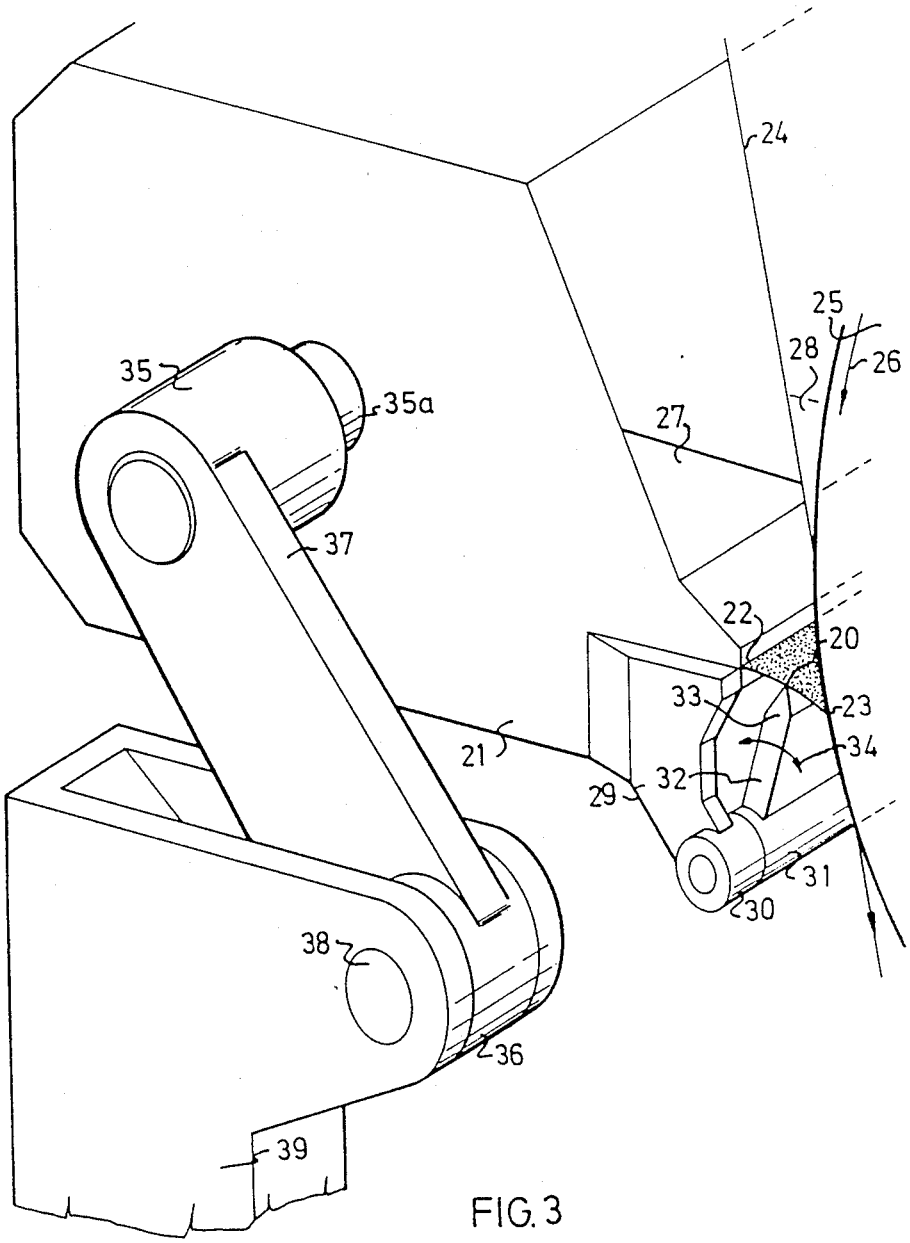
FIG. 3 is a schematical sideview of a first embodiment of a device according to the invention.

In FIG. 3 there is shown a device implemented in accordance with the invention, wherein the curve described by the support is constituted by a circle arc. In this embodiment there is shown the blade holder in a coating device according to the so called BILL-BLADE-method. A coating blade 20 is clamped in a blade holder 21. The free end of the coating blade 20 forms an arc between the forward portion 22 of the blade holder and the engagement point 23 against a paper web 24 which partly encircles a roller 25 rotating in the direction of arrow 26. There are two dams 27,28 of application agent in surplus on both sides of the paper web 24. At the lower portion of blade holder 21 there is an end plate 29 fixed at both ends of the blade holder. However, in FIG. 3 only one side of the blade holder is shown. A bearing housing 30 is fixed at the end plate 29, and a shaft 31 is rotatably arranged in the bearing housing. The shaft 31 extends in parallel to the forward edge 22 of the blade holder. A camlike protrusion, a so called support ruler, 32 is fixed on the shaft 31, this protrusion forming at the outer end 33 thereof a support 33 in the shape of a point. The support 33 provides a certain pressing against the blade 20. The support roller 32 can thus be turned thereby describing a circle arc in the direction of arrow 34.

The device according to FIG. 3 corresponds to the fundamental design according to FIG. 2. It has turned out to be possible to directly obtain the desired application amount in the very simple embodiment shown in FIG. 3 by turning the shaft 31 of the adjustment device so that the support 33 takes a suitable position in its pressing against the blade 20. As discussed above, this is due to the circumstance that the engagement angle $\alpha$ of the blade remains unchanged or substantially unchanged at different positions of the support 33. A precondition is however that the bevel surface of the blade entirely engages the paper web, i.e. that the blade tip angle $\beta$ equals the engagement angle $\alpha$—compare FIG. 1. As previously mentioned, this can be achieved by the wearing in of the blade, but the most suitable way is to use preground blades having a bevel with a suitable blade tip angle.

In coating by means of devices suggested in accordance with the invention, a coating blade is suitably chosen, having a preground bevel, the angle of which fits the position the blade will take. The device according to FIG. 3 has been made in order to enable coating with different bevel angles, as sometimes can be desirable. By turning the blade stock around the blade engagement point with the paper web, it is possible to preset the blade so that the preground bevel of the blade engages the paper web along the entire blade length. This possibility brings about certain advantages. In coating it is for different reasons sometimes desirable to work with an acute blade tip angle for example. In such a case the blade will take a somewhat trailing configuration. If in such a case it is decided to choose a blade tip angle of for example 10°, such a blade is fixed in the bladeholder, whereafter the bladestock is turned around the engagement point of the blade with the paper surface, until the blade bevel is parallel to the paper web. This is achieved in the following way.

In the bladeholder 21 two shaft taps are arranged of which one shaft tap 35*a* is shown in FIG. 3. The tap 35*a* is in turn rotatably journalled in a bearing 35 in a crank 37, at the other end of which a bearing 36 is arranged. The bearing 36 and thereby the crank 37 is pivotably journalled around the shaft tap 38 which is arranged in the stand 39. The extended centre line of the shaft tap 38 coincides with the engagement line of the blade tip 23 with the paper surface. By turning the blade holder 21 with the crank 37 around the tap 38, the tip of blade 20 can be brought into a position where the blade bevel surface which acts against the paper web becomes parallel with the paper web.

During the actual coating, the device according to FIG. 3 operates in the following manner. First a blade is chosen, having a suitable blade tip angle and a suitable thickness for the purpose. The blade is inserted in the blade holder 21 which thereafter is adjusted so that the blade in operation position has its bevel surface acting in parallel with the paper web as described above. At the same time as the blade holder is moved into its operation position, for example by turning around tap 35*a*, the tip of the pivotable support roller 32 will press against the blade, giving a certain pressure against the paper web. During the coating the application amount can thereafter be regulated by a simple turning of the support roller 32 by means of suitable devices, which however are not shown in detail in FIG. 3.

Figure 4:
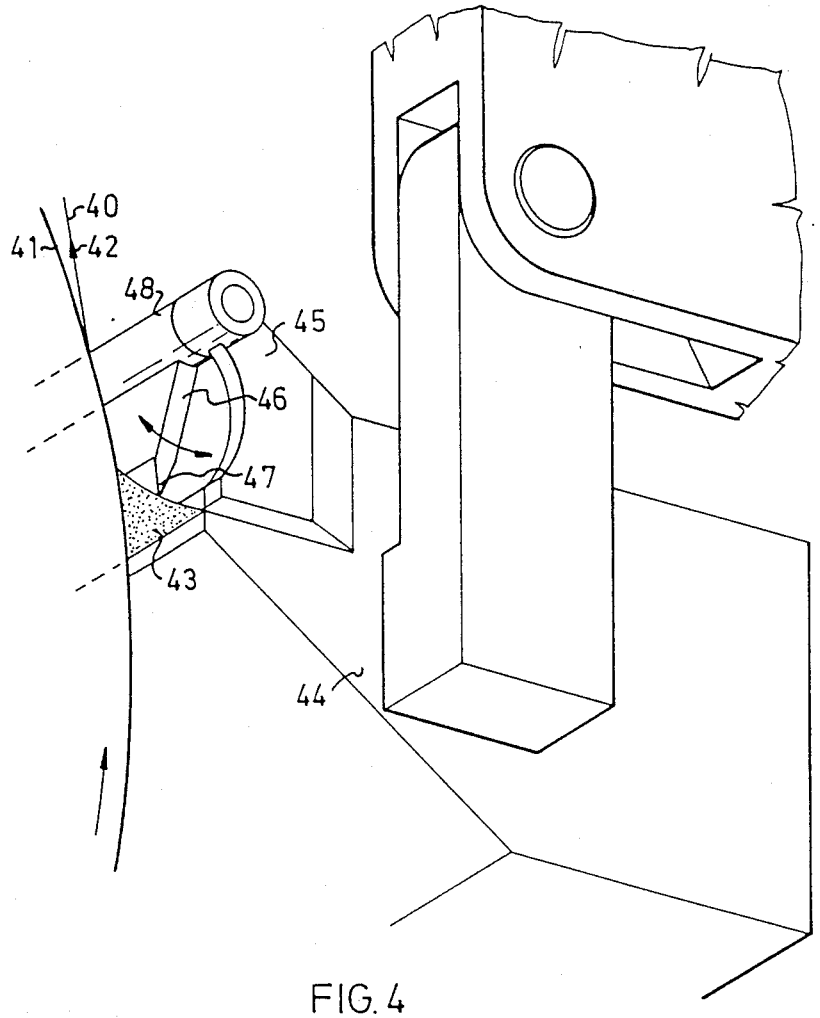
FIG. 4 is a schematical sideview of a second embodiment of a device according to the invention.

In FIG. 4 there is shown a corresponding device according to the invention in a single-sided blade-coater of traditional structure—a so called inverted blade-coater. A paper web 40 is fed by a roller 41 in the direction of arrow 42. A coating blade 43 is clamped in a blade holder 44. A surplus of coating agent which from below has been supplied to the paper web, which however is not closer shown, is scraped off by means of the blade 43. Two end plates are arranged at both sides of the bladeholder 44, but only one 45 of the end plates is shown in FIG. 4. In the end plate 45 a cam plate or support roller 46 is pivotably arranged, and the point 47 of the cam plate presses down the blade so that it takes arc shape. The cam plate 46 is fastened to a turnable shaft 48. The device according to FIG. 4 is used in the same manner as previously has been described in connection to FIG. 3 as to the setting of desired application amount of coating mass.

Figure 5:
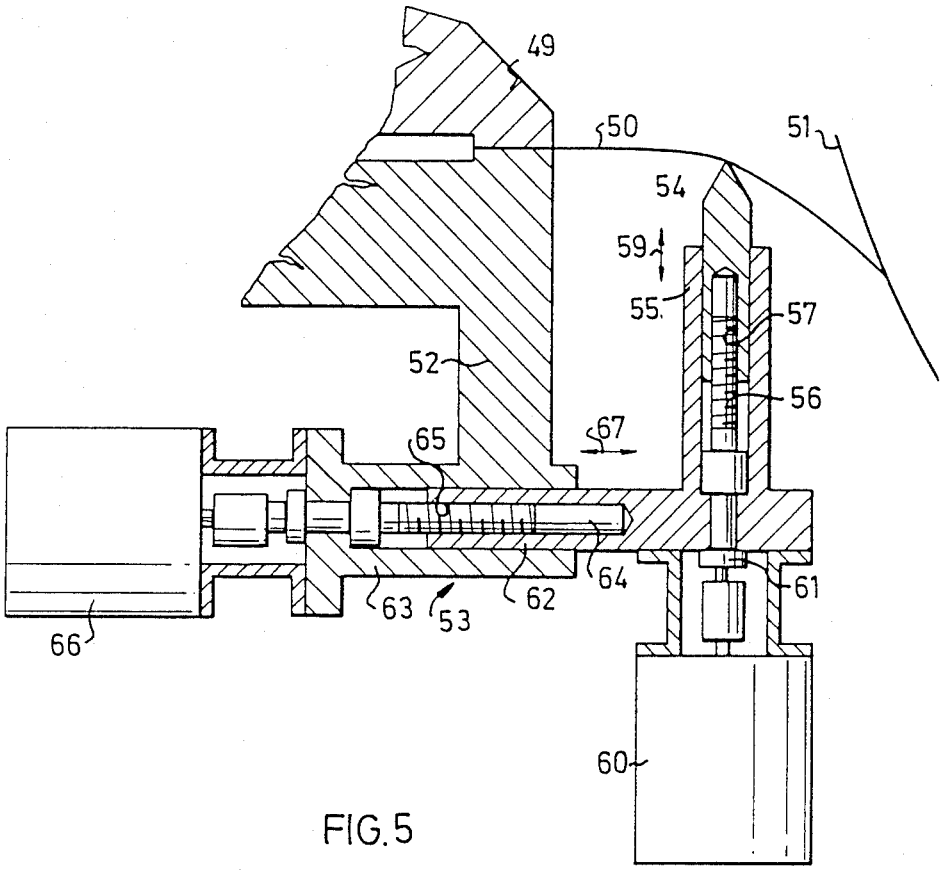
FIG. 5 is a view of principal of a device according to the invention with special adjustment devices.

In FIG. 5 there is shown another embodiment of the invention for the adjustment of the application amount. A blade 50 is clamped in a blade holder 49, and the blade contacts a paper web 51 supported by a roller, not shown. In the lower portion 52 of the blade holder 49 there is an adjustment device 53 comprising a number of support means 54 of which only one support means is shown in FIG. 5, said support means being arranged in a row adjacent each other. The support means 54 as well as the other not shown supports engage in pointwise contact the blade 50 in line and in parallel with the forward edge of the blade holder 49. The support means 54 can be circularly and slidably arranged in the bearing housing 55 and can by actuation of a screw 56 and the corresponding inner thread 57 be brought to move up and down in vertical direction as is shown by the arrows 59. The vertical reciprocating movement is provided by a step motor 60 which via a clutch 61 turns the screw 56 in one or the other direction. The bearing housing 55 is perpendicularly connected to another bearing housing 62 which is displacably journalled in a bearing 63. The support 54 can also be brought into a horizontal movement in the direction of arrows 67 by turning of the screw 64 in the thread 65 by means of the step motor 66.

A means of the shown device, the support 54 and the other in a row after each other arranged but not shown supports can be brought to glide along an arc-shaped curve while pressing and engaging the blade 50. This curve can by feeding of suitably chosen signals to the respective step motor be given the desired configuration in accordance with the invention. As previously mentioned, the movement may well be constituted by a circle arc, but may also be constituted by a different arc in adjacent configuration, for example an ellipse arc. In some cases a fully acceptable result can also be achieved with an at least approximately straight line.

Another advantage achieved by the device according to FIG. 5 is that it is possible individually to regulate the length of the different support means hereby compensating for example inlinearity of the blade holder, or variations of the paper web, which sometimes may cause an uneven coating across the web.

Also the devices shown in FIGS. 3 and 4 with pivotable support rollers 32 and 46 respectively, can be replaced by a number of pressing means which are arranged in a row adjacent each other.

In some cases it is preferred that the individual pressing means arranged in a row act on a bar flexible at least in a plane and arranged along the entire length of the blade and pressing against the blade. Suitably the pressing means are joined to the bar by means of for example thread joints.

Figure 6:
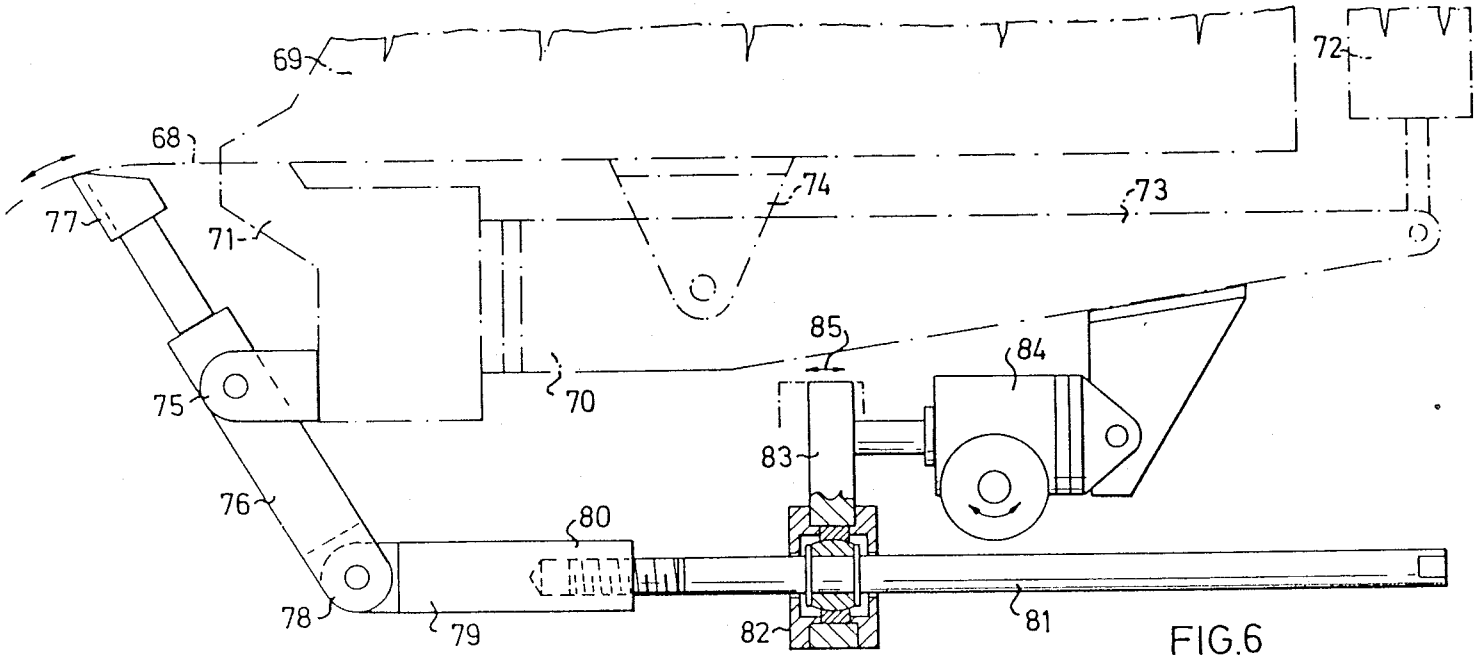
FIG. 6 is a sketch of principal of a further embodiment of the device according to the invention.

The embodiment shown in FIG. 6 shows moreover a blade pressure regulating device according to the invention with separately adjustable pressing means which act on a common support bar. A coating blade 68 clamped in a blade holder 69 the lower portion of which consists of a clamping device 70 with a jaw 71 for clamping the blade by means of a movable pressing means in the form of a cylinder 72 and a rocker 73 in a bearing bracket 74. A linkarm 76 is pivotably fastened in another bearing bracket 75 which is fastened at the forward portion of the clamping device 70. The upper portion of the linkarm is connected to a support bar 77, and the opposite portion thereof forms a joint 78, which is connected to another linkarm 79 in which also the forward end 80 of an adjustment screw 81 is threaded in. The adjustment screw is journalled in the spherical bearing 82 which is fastened at a crossbeam 83. The crossbeam is by means of a screw jack 84 fastened in the jaw 71 displacable in the direction of arrows 85. The support bar 77 with associated linkarm system and adjustment screws, is arranged parallel to the forward edge of the blade. A suitable distance between each individual linkarm is 150 mm.

In coating by means of the device shown in FIG. 6, a new blade 66 is inserted, whereafter this blade is clamped in the jaw 71 by means of the pressing cylinder 72, which presses downwardly. When the blade holder is brought into work position, also the support bar 77 is brought into contact with the blade, which then is bent to a curve hinted in the figure, because it simultaneously presses with its point against a coating roller not shown. In coating the application amount can be set in accordance with the previous description. This is done thereby that the crossbeam 83 is displaced horizontally by means of the screw jack 84 until the correct coating amount has been obtained. In order to obtain for example individual setting of the linkarm 76 the adjustment screw 81 is turned whereby the linkarm 76 is affected so that corresponding portions of the support bar 77 are displaced into a position somewhat deviating in relation to the other portions of the support bar.

In FIG. 7 there is shown in a table the results of a series of tests which have been performed with devices according to the invention in coating, partly in a so called BILLBLADE-coater corresponding to the device according to FIG. 3, partly in a so called inverted blade-coater corresponding to the device according to FIG. 4. The notations stated in FIG. 7 for the radius R, the x-y-coordinates, the force F and the angles $\gamma$ and $\alpha_3$, refer to the notations in FIG. 2.

The columns in FIG. 7 have been denoted A–M, wherein:

A means blade thickness, mm,
B means deflection angle $\gamma°$,
C means the support movement curve,
D means the radius R of the movement curve in mm,
E means the centre of the circle arc in x-y-coordinate, mm,
F means the action point of the force F in x-y-coordinate, mm,
G means the support position in x-y-coordinates, mm,
H means the blade pressure F N/cm,
I means coating method
J means bladetip angle to counterroller, $\alpha_3°$,
K means machine velocity, m/min,
L means smear properties, dry ratio %/viscosity cP,
M means application amount g/m$^2$.

The tests revealed that the obtained application amounts are reproduceable, i.e. during a run it was possible to reset the application amount from larger to smaller application amount and vice versa a repeated number of times, and the same application amount was always obtained at a certain setting. It was also noted that at a resetting the new application amount was obtained immediately and thereafter remained constant.

Although the invention has been described in connection with different types of blade coaters with a single active blade, the invention is not limited to this. The invention may also well be used in for example coating devices where two doctor blades which act against each other are used, for example as in the so called Twinblade-method method.

As is readily appreciated, the inventive technique can be defined in different ways. The blade is resilient and supported at one edge thereof. The opposite scraping edge of the blade engages the support via the web. A force, exerted by a pressing means, acts against one of the main sides of the blade in a position between the blade holder and the free blade edge, whereby the blade takes a concave shape and whereby the engagement pressure exerted by the blade on the web will be dependent on said force. By changing the magnitude of said force, the engagement pressure of the blade against the web can be changed, but then the angle of the free blade edge with the web will also be changed, whereby the above mentioned disadvantages occur. According to the invention the desired engagement pressure between the blade and the web is set by changing the magnitude of the force as well as the position for the attack point of the force against the blade in the transverse direction of the blade (in direction towards and away from the web) in such a way that the angle formed between the free blade edge and the web substantially is maintained. In principle there is for each force attacking point a force which provides the desired blade engagement force against the web, but there is only one force attack position which then provides a maintained blade top angle with the web. Because the blade is elastical it is not necessary directly to measure or define the force to be exerted by the blade, because forces of different magnitudes correspond to certain blade deflections in each force application point. In structure it is thus possible to calculate or empirically provide a curve for the interaction points between a force exerting means and the concave blade surface, whereby the invention easily can be carried out. The said curve should be considered as lying in a plane which is perpendicular to the plane of the web and being in parallel with the running direction of the web. This curve has then such a curvature that the pressing force of the blade against the web varies with the position of the force exertion means along said curve, at the same time as the blade top angle remains substantially constant. In apparatus terms the device could be considered distinguished substantially by means for maintaining a mainly constant blade top angle with the web at changing of the engagement force of the blade against the web. Said means can then comprise means for displacing a pressure exertion means on the concave side of the blade towards and away from the free scraping longitudinal edge of the blade along a curve which has such a curvature that the engagement force between the blade and web increases as the force application point comes closer to the web, at the same time as the blade top angle remains substantially constant. Thus it is possible to find a correlation between the engagement pressure between the blade and the web, and on the other hand the attack position of the pressure exerting means on the blade in the transverse direction of the blade. Then a desired blade engagement pressure or a desired change of blade engagement pressure can easily be obtained by a predetermined displacement of the pressure means along the control curve.

What is claimed is:

1. A method of varying the application amount of coating agent applied by bladecoating of a moving web, preferably a paper web, by control of engagement pressure of a coating blade against the web, the web supported by a rotating support roller, said blade clamped into a blade holder along one longitudinal edge, an opposite longitudinal edge of said blade being in engagement with the web and being in a substantially arcuate shape with predetermined angle defined between a tip of the blade and the web so as to define an area of engagement, comprising, displacing a control pressure acting on a major surface of the blade in a transverse direction of the blade towards and away from the web and controlling the size of the control pressure to the blade position to provide a predetermined blade engagement pressure against the web by said displacing of the control pressure and to substantially constantly maintain the angle between the web and the blade tip.

2. A method according to claim 1, wherein the position dependent control pressure is provided by exerting the control pressure with a pressing means, which acts on the blade and by displacing the pressing means along a predetermined path in the transverse direction of the blade.

3. A method according to claim 2 wherein said path is substantially circle shaped.

4. A method according to claim 2 wherein said path is substantially ellipse shaped.

5. A method according to claim 1 wherein said force influence occurs simultaneously along the entire length of the blade.

6. A method according to claim 1 wherein said control pressure is provided by means of a pressing means or support means which is displacable along the concave side of the blade.

7. A method according to claim 1 wherein the displacement of the pressure means is data controlled depending on the application amount sensed.

8. A method according to claim 1 wherein a varying force influence is exerted along the length of the blade.

9. A method according to claim 8 wherein said varying force influence on the blade is provided via a bar which is flexible at least in a plane, and is located between the pressing means and the blade side facing the pressing means, said bar pressing the engaging blade.

10. A device for changing an amount of coating agent from a surplus of the coating agent applied to a moving web by blade coating by control of an engagement pressure of the coating blade against the web, the web being supported by a rotatable support roller, said blade being clamped in a blade holder along one longitudinal side of the blade, the opposite longitudinal side of said blade being initially forced into engagement with the web so that the blade tip has a predetermined angle with the web, means for displacing a pressure element acting on a major surface of the blade in a transverse direction of the blade towards and away from the web, and a control means for controlling selected displacement positions of the pressing element to exert a pressure and control the angle between the blade tip and the web substantially constant corresponding to different displacement positions of the pressing means.

11. A device according to claim 10, wherein the control means comprises a control curve which defines the blade deflections caused by the pressing means in the varying displacement positions, said blade deflections defining the pressure exerted by the pressing means.

12. A device according to claim 10 characterized in that the pressure element includes a pivotally arranged support with a support apex arranged adjustably along a path which substantially coincides with the arc shape of the blade, the support roller extending along the entire length of the blade and the support apex being connected to a shaft which is rotatably arranged at the blade holder, said support being arranged adjustably along a mainly circular path.

13. A device according to claim 11, wherein the pressing means includes the pivotally arranged support with a support apex arranged adjustably along a path which substantially coincides with the arc shape of the blade, the support extends along the entire length of the blade and that the support is connected to a shaft which is rotatably arranged at the blade holder, said support being arranged adjustably along a mainly circular path.

* * * * *